US008915107B2

(12) United States Patent
Hertel et al.

(10) Patent No.: US 8,915,107 B2
(45) Date of Patent: Dec. 23, 2014

(54) LOCKING SYSTEM

(75) Inventors: Jorg Hertel, Hohndorf (DE); Thomas Pechmann, Oelsnitz (DE)

(73) Assignee: Abus Pfaffenhain GmbH, Jahnsdorf (DE)

( * ) Notice: Subject to any disclaimer, the term of this patent is extended or adjusted under 35 U.S.C. 154(b) by 128 days.

(21) Appl. No.: 12/908,576

(22) Filed: Oct. 20, 2010

(65) Prior Publication Data

US 2011/0252846 A1 Oct. 20, 2011

(30) Foreign Application Priority Data

Oct. 21, 2009 (DE) ..... 10 2009 050 129

(51) Int. Cl.
*E05B 27/00* (2006.01)
*E05B 19/00* (2006.01)

(52) U.S. Cl.
CPC ..... *E05B 27/0021* (2013.01); *E05B 27/0042* (2013.01); *E05B 19/0029* (2013.01)
USPC ..... 70/493; 70/494; 70/409; 70/406; 70/390; 70/378; 70/358

(58) Field of Classification Search
USPC ..... 70/336, 393, 493, 409, 405, 406, 358, 70/492, 356, 357, 378, 352, 392, 70, 495, 70/389, 390, 407, 494, 359, 454
See application file for complete search history.

(56) References Cited

U.S. PATENT DOCUMENTS 2,022,070 A * 11/1935 Williams et al. ..... 70/421
2,105,304 A * 1/1938 Wagner ..... 200/43.05
3,395,558 A 8/1968 Russell et al.
3,742,744 A * 7/1973 Lumme ..... 70/358
3,877,267 A 4/1975 Harris, Jr.
4,377,082 A * 3/1983 Wolter ..... 70/493

(Continued)

FOREIGN PATENT DOCUMENTS

AT 000591 U1 12/1995
DE 2201281 7/1973

(Continued)

OTHER PUBLICATIONS

German Search Report and English translation of the same dated Aug. 24, 2010.

(Continued)

*Primary Examiner* — Lloyd Gall
*Assistant Examiner* — Myles Throop
(74) *Attorney, Agent, or Firm* — Amster, Rothstein & Ebenstein LLP

(57) ABSTRACT

A locking system is set forth having a key and a lock cylinder. The lock cylinder has a cylinder core journalled in a housing and having a keyway for inserting the key. A plurality of tumblers actuable by the key and an additional blocking element movably arranged in a guide passage of the cylinder core project into the keyway, said additional blocking element being displaceable obliquely or transversely to the direction of insertion of the key. The additional blocking element is made for cooperation with a counter-element arranged at the key blade with a key introduced up to the maximum insertion depth. The counter-element is in this respect arranged in a groove or recess starting from the key tip and extending in the longitudinal direction of the key blade.

11 Claims, 9 Drawing Sheets

(56) References Cited

U.S. PATENT DOCUMENTS

Figure 1:
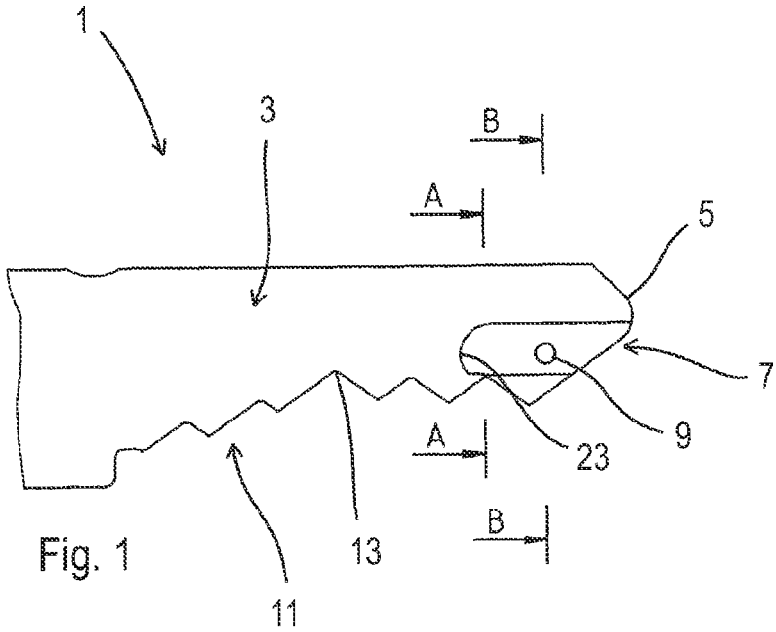

| | | | | | |
|---|---|---|---|---|---|
| 4,905,489 | A * | 3/1990 | Keller | 70/378 | |
| 5,123,268 | A * | 6/1992 | Eizen | 70/359 | |
| 5,181,406 | A * | 1/1993 | Wolter | 70/337 | |
| 5,488,843 | A * | 2/1996 | Shi | 70/1.5 | |
| 5,520,035 | A * | 5/1996 | Eizen et al. | 70/358 | |
| 5,715,717 | A * | 2/1998 | Widen | 70/493 | |
| 5,819,566 | A * | 10/1998 | Eden, Jr. | 70/358 | |
| 5,819,567 | A * | 10/1998 | Eden, Jr. | 70/390 | |
| 5,823,030 | A * | 10/1998 | Theriault et al. | 70/419 | |
| 5,839,308 | A * | 11/1998 | Eizen et al. | 70/358 | |
| 5,943,890 | A * | 8/1999 | Field et al. | 70/493 | |
| 6,119,496 | A * | 9/2000 | Theriault | 70/406 | |
| 6,257,033 | B1 * | 7/2001 | Ziv-Av | 70/494 | |
| 6,442,986 | B1 * | 9/2002 | Russell et al. | 70/278.3 | |
| 6,519,988 | B1 * | 2/2003 | Wu | 70/358 | |
| 6,615,628 | B2 * | 9/2003 | Lou | 70/409 | |
| 6,945,082 | B2 * | 9/2005 | Field et al. | 70/409 | |
| 7,207,200 | B2 * | 4/2007 | Eden et al. | 70/358 | |
| 7,647,799 | B2 * | 1/2010 | Markbreit et al. | 70/409 | |
| 8,065,897 | B2 * | 11/2011 | Teixeira | 70/367 | |
| 2002/0189309 | A1 * | 12/2002 | Stemmerik | 70/493 | |
| 2004/0000178 | A1 * | 1/2004 | Tseng | 70/358 | |
| 2005/0072199 | A1 * | 4/2005 | Edwards, Jr. | 70/493 | |
| 2005/0210939 | A1 * | 9/2005 | Divito | 70/409 | |
| 2006/0207303 | A1 * | 9/2006 | Almagor et al. | 70/493 | |
| 2006/0230797 | A1 * | 10/2006 | Strong et al. | 70/371 | |
| 2006/0272372 | A1 | 12/2006 | Talamonti et al. | | |
| 2009/0272161 | A1 * | 11/2009 | Talamonti | 70/491 | |
| 2011/0079059 | A1 * | 4/2011 | Piotrowski et al. | 70/378 | |
| 2011/0146360 | A1 * | 6/2011 | Ben-Aharon et al. | 70/490 | |

FOREIGN PATENT DOCUMENTS

| | | | | |
|---|---|---|---|---|
| DE | 3542008 | A1 | 6/1987 | |
| DE | 4301705 | A1 | 7/1994 | |
| DE | 19919568 | A1 | 11/2000 | |
| DE | 10031972 | A1 | 1/2002 | |
| DE | 10050460 | A1 | 4/2002 | |
| DE | 102004021580 | B3 | 11/2005 | |
| DE | 102006061224 | B3 * | 1/2008 | E05B 9/04 |
| DE | 102006059599 | A1 | 6/2008 | |
| EP | 0161654 | B2 | 6/1994 | |
| EP | 0567446 | B1 | 1/1996 | |
| EP | 0569997 | B1 | 9/1996 | |
| EP | 0607993 | B1 | 1/1997 | |
| EP | 0637663 | B1 | 4/1998 | |
| EP | 1048804 | B1 | 1/2004 | |
| EP | 1593800 | A2 * | 11/2005 | E05B 19/06 |
| EP | 1835095 | A1 | 9/2007 | |
| EP | 1939377 | A1 | 7/2008 | |
| EP | 2022912 | A2 | 2/2009 | |
| WO | 9832937 | A1 | 7/1998 | |
| WO | 0177466 | A1 | 10/2001 | |
| WO | 02064921 | A1 | 8/2002 | |
| WO | 03064795 | A1 | 8/2003 | |
| WO | 2007144093 | A1 | 12/2007 | |

OTHER PUBLICATIONS

European Search Report corresponding to European Patent Application No. DE 102009050129.0 mailed May 21, 2012.

* cited by examiner

LOCKING SYSTEM

The invention relates to a locking system having a key and a lock cylinder which has a cylinder core which is journalled in a housing and which has a keyway for introducing the key, wherein a plurality of tumblers actuable by the key and an additional blocking element arranged movably in a guide passage of the cylinder core and displaceable obliquely or transversely to the insertion direction project into the keyway, with the additional blocking element being made for cooperation with a counter-element arranged at the key blade with a key inserted up to a maximum insertion depth.

Locking systems of this kind are known in accordance with the internal level of knowledge of the applicant.

The fact is problematic with such locking systems that a special modification of the keyway in the form of a profile complementary to the counter-element of the key blade is required so that the counter-element of a key protruding from the key blade can be introduced into the keyway with its. The manufacturing effort and/or cost of the locking system, in particular of the lock cylinder belonging to the locking system, is thereby increased.

It is the underlying object of the invention to achieve a simplification of the production of the lock cylinders in locking systems of the initially named kind with a simultaneous increase in the security against breaking open.

In accordance with the invention, this object is satisfied by the features of claim 1 and in particular in that, in the locking system in accordance with the invention, the counter-element is completely arranged in a groove or recess staring from the key tip and extending in the longitudinal direction of the key blade.

A locking system in accordance with the invention is thereby provided in which the keyway of the lock cylinder does not have to be separately provided with an additional profile for the counter-element since in accordance with the invention the counter-element is arranged completely in the groove or recess. The manufacture of the lock cylinder can thus be substantially simplified because no worksteps have to be provided for producing a profile of the keyway for the counter-element. In accordance with the invention, conventional lock cylinders having a profile of the keyway also previously usual can rather form the basis for the manufacture of a locking system in accordance with the invention without a complex and/or expensive introduction of an additional profile into the keyway being necessary in these lock cylinders.

Furthermore, in addition to the tumblers known from conventional keys, an additional blocking of a rotary movement of the lock cylinder can be achieved by the additional blocking element. In this respect, the additional blocking element only cooperates with a "matching" key belonging to the same locking system as the lock cylinder in accordance with the invention such that no additional blocking takes place during the rotary movement or such that an unlatching of an additional blocking takes place with a key inserted up to a maximum in the lock cylinder. In this respect, as will be explained in detail in the following, a plurality of different additional permutations can be achieved in the locking system in accordance with the invention, whereby the locking system in accordance with the invention ensures a high security.

Finally, in the locking system in accordance with the invention, the security is also increased in that no commercial key blanks can be used for manufacturing unauthorized copies since they normally do not have any groove or recess like the keys of the locking system in accordance with the invention. On the other hand, even on the presence of a suitable groove or recess in a blank copied without authorization, the correct design and arrangement of the counter-element can only be realized within the groove or recess with difficulty.

Further developments and embodiments of the invention are set forth in the dependent claims.

The additional blocking element in the guide passage is preferably displaceable in translation or in a linear manner. The guide passage can thereby be realized in a particularly simple manner, for example by means of one or more bores.

The key preferably does not have any moving part. The counter-element is in particular attached to the key as a static part or is formed at the key. The key can thereby be simply manufactured and is relatively robust with respect to external influences in comparison with a key with moving parts.

The end region of the groove or of the recess remove from the key tip preferably forms an abutment element at the key side which defines, with an abutment element at the lock cylinder side which projects into the keyway, the maximum insertion depth of the key into the keyway. The use of the end region of the groove or of the recess as an abutment element at the key side in combination with the abutment element at the lock cylinder side has the advantage that additional permutation possibilities result with a design and/or arrangement of the abutment element at the lock side and at the lock cylinder side respectively different from locking system to locking system. Said permutation possibilities can be increased even further in that at the key side the arrangement of the counter-element relative to the abutment element at the key side is varied from locking system to locking system and, at the lock cylinder side, the arrangement of the additional blocking element relative to the abutment element at the lock cylinder side is varied in a corresponding manner.

Furthermore, in conventional, generally known keys, only one abutment element is usually provided which is located between the key head and the key blade and which cooperates with an end face of the lock cylinder with an inserted key. With the previously described embodiment of the locking system in accordance with the invention, such a cooperation can be avoided since all the abutment elements can be arranged within the keyway and spaced apart from the key tip with a key introduced into the keyway. This advantageously has the consequence that commercial key blanks cannot be used for manufacturing unauthorized copies since they do not have such an abutment element at the key side.

In accordance with a preferred embodiment of the invention, a guide element arranged in the cylinder core forms the guide passage for guiding the additional blocking element and projects so far into the keyway that the guide element forms an abutment element at the lock cylinder side which defines the maximum insertion depth of the key into the keyway, said abutment element at the lock cylinder side being for an abutment element at the key side which is formed by the end region of the groove or of the recess remote from the key tip. Accordingly, the guide element has a dual function since it is used, on the one hand, for the guidance of the additional blocking element movably arranged in the guide passage and, on the other hand, as an abutment for bounding the maximum insertion depth of the key. An additional abutment element at the lock cylinder side which is arranged in a separate recess in the cylinder core can thus be saved, which simplifies the production of the lock cylinder.

In accordance with another variant, the abutment element at the lock cylinder side can be realized particularly simply if it is made in the form of a pin or similar. In this respect, such a pin-type abutment element at the lock cylinder side is preferably rigidly connected to the cylinder core, is in particular fixedly pressed with the cylinder core, and in particular extends parallel to the guide passage of the additional blocking element.

The abutment element at the lock cylinder side can, however, also be releasably connected to the cylinder core. In this case, the abutment element at the lock cylinder side is preferably made in the form of an insertion piece. A conventional cylinder core can be retrofitted in a simple manner with an abutment element at the lock cylinder side by means of such an insertion piece; for example in that a matching indentation, extending transversely to the direction of insertion, is introduced into the cylinder core and the insertion piece is inserted into this indentation.

A groove having the counter-element is preferably formed at a broad side of the key blade. In this respect, the groove in particular forms an elongate cut-out at the broad side of the key blade which extends, starting from the key tip, in the longitudinal direction of the key blade, that is in the direction of insertion of the key. In contrast, a recess used instead of the groove and having the counter-element is preferably formed at a longitudinal side of the key blade. Such recesses are preferably only used within the framework of the invention with non-symmetrical keys on the longitudinal side of the key blade which corresponds to the key rear and which is opposite the key bit. In contrast, a groove in the above sense can be used both with a symmetrical key, in particular with a symmetrical flat key or reversible key and with non-symmetrical keys.

In accordance with a further embodiment of the invention, the groove or the recess has different depths in different keys. Further permutation possibilities with respect to the number of different available keys or locking systems can thereby be provided by a depth of the groove or of the cut-out varying from locking system to locking system.

The groove or the recess can also have different lengths, with respect to the longitudinal direction of the key or to the direction of insertion of the key in different keys, whereby further additional permutation possibilities are provided.

In accordance with a further development of the invention, the groove or the recess and the end of the abutment element at the cylinder side projecting into the keyway have complementary surfaces which in particular contact one another areally with a key inserted into the keyway. It can be ensured in a simple manner by this measure that an unauthorized key, which does not have any groove or recess suitably made for the lock cylinder, already abuts the abutment element at the lock cylinder side on the introduction of the key and can therefore not be introduced further into the keyway so that an unauthorized actuation of the lock cylinder can already be effectively prevented by this measure. To this extent, additional permutations can in turn be realized on formation of the complementary surfaces of the groove or recess at the key side, on the one hand, and of the abutment element at the lock cylinder side, on the other hand, different from locking system to locking system.

In accordance with a further embodiment of the invention, the abutment element at the lock cylinder side and the additional blocking element are arranged behind one another in particular at a preset spacing in the direction of insertion of the key. In this respect, the abutment element at the lock cylinder side and the additional blocking element preferably substantially have no transverse offset relative to one another with respect to the direction of insertion of the key. Since the abutment element at the lock cylinder side preferably cooperates with the end region of the groove or of the recess remote from the key tip, the counter-element arranged in the groove or recess has to be moved past the abutment element at the lock cylinder side on the insertion of the key into the keyway in the aforesaid embodiment of the invention so that the counter-element is located between the abutment element at the lock cylinder side and the key tip with a key inserted up to the maximum insertion depth. In this respect, in particular when the counter-element is made in the form of an accentuated portion, additional permutations in turn result since only those keys can be introduced into the keyway in which a counter-element formed as an accentuated portion is offset less far from the groove or the recess than the abutment element at the lock cylinder side projects into the keyway.

In accordance with a further development of the invention, the counter-element is made in the form of an elevated portion preferably of partly spherical, frustoconical or pin shape. A counter-element can thereby be realized particularly simply within the groove or the recess of the key blade from a technical manufacturing aspect. The elevated portion is in this respect preferably formed by a slotted nail or by a pressed or welded pin.

The abutment element at the lock cylinder side preferably has a cut-out which is complementary to the elevated portion, which extends in the longitudinal direction of the keyway and through which the elevated portion is movable on the introduction of the key. The complete introduction of an unauthorized key into the keyway can thereby already be prevented in a particularly simple and efficient manner since only those keys can be introduced into the keyway beyond the abutment element at the lock cylinder side whose counter-element corresponds with respect to the arrangement and the design with the cut-out of the abutment element at the lock-cylinder side so that in this embodiment in accordance with the invention further permutation possibilities are again also provided.

The elevated portion preferably has different heights and/or is received in different positions in the groove or in the recess, in particular for the purpose of realizing further permutations with different keys.

The additional blocking element in the guide passage is preferably outwardly displaceable by the elevated portion from a starting position in which the additional blocking element is inwardly spaced apart from the peripheral surface of the cylinder core into an aligned position with the peripheral surface of the cylinder core. In this respect, the guide passage is located in the same cross-section plane of the cylinder core as a tumbler so that the additional blocking element located in the aligned position prevents a housing pin of the tumbler from being able to penetrate into a section of the guide passage which is made correspondingly large and which is adjacent to the peripheral surface of the cylinder core on a rotation of the lock cylinder core. A blocking of the rotary movement of the lock cylinder can thereby be avoided in a particularly simple manner simply by displacement of the additional blocking element due to the effect of the elevated portion.

The additional blocking element can in this respect be made in a purely passive manner so that it is neither acted on by a spring nor itself effects a blocking of the rotary movement of the cylinder core. The additional blocking element can rather only prevent a housing pin from blocking the continuation of a rotary movement of the cylinder core, as is described above.

In accordance with another preferred further development of the invention, the additional blocking element is a so-called active blocking element which can be or is acted on by a spring and which itself effects a blocking of the rotary movement of the cylinder core. Such an additional blocking element can preferably be actuated by the elevated portion such that it is displaced in the guide passage from a latched position in which the single-part or multipart additional blocking element blocks a rotary movement of the lock cylinder—independently of the previously mentioned tumblers—into an unlatched position in which no blocking takes place.

Alternatively to the described elevated portion, the counter-element can also be formed by an additional depression introduced into the groove or the cut-out. It is advantageous in this that such a counter-element can be realized particularly easily from a technical manufacturing aspect, for example in that the additional depression is made in the form of a bore.

Additional permutation possibilities can in particular also be realized in embodiments of the locking system in accordance with the invention in which the counter-element is formed at the key blade in the form of a depression in that the depression preferably has different depths and/or shapes in different keys and/or is introduced into the groove or recess at different positions, with the additional blocking element also having correspondingly different lengths and/or shapes and/or positions in a corresponding manner in different lock cylinders.

In accordance with a further embodiment in accordance with the invention, the additional blocking element is made such that it is displaced from the groove or from the recess in the guide passage on the introduction of the key such that an end of the additional blocking element adjacent to the inner surface of the cylinder housing engages into a recess in the cylinder, with a prolongation complementary to the depression being arranged at an end of the additional blocking element adjacent to the keyway so that the prolongation only penetrates into the depression at the maximum insertion depth of the key, whereby the additional blocking element is displaced such that it is located completely within the jacket surface of the cylinder core. The additional blocking element can thus first be displaced on the introduction of the key with a key made matching the lock cylinder into a latched position in which a blocking of a rotary movement of the lock cylinder takes place. With a key inserted to the maximum, however, the prolongation at the additional blocking element at the lock cylinder side can penetrate into the depression, whereby the additional blocking element is located completely within the jacket surface of the cylinder core and the blocking is cancelled.

In the previously set forth embodiments and further developments of the locking system in accordance with the invention, the key includes either a groove or a recess. The key can, however, naturally also have both a groove, in particular at the broad side of the key blade, and a recess, in particular at the key rear, each having at least one counter-element arranged therein. In this respect, it is additionally mentioned that in accordance with the invention a plurality of counter-elements can naturally also be arranged in a single groove or recess. In a corresponding manner, a lock cylinder belonging to the respective key then has a plurality of additional blocking elements.

The invention furthermore relates to a key for use in a locking system in accordance with the invention. In the key in accordance with the invention, an elevated portion or a depression is arranged completely in a groove or recess starting from the key tip and extending in the longitudinal direction of the key blade. The keyway at the lock cylinder side matching the key thereby does not have to be modified so that the manufacturing effort and/or cost of the lock cylinder corresponding to the key can be kept low even though a variety of possibilities to provide additional permutations are nevertheless present by the key-cylinder lock combination of the locking system, as presented above.

The invention also relates to a set of keys having a plurality of keys of the same kind in accordance with the invention. In this respect, the elevated portion has different heights with different keys and/or is received at different positions in the groove or cut-out. In a corresponding manner, the depression can have different depths and/or shapes with different keys and/or can be introduced into the groove or cut-out at different positions. As already previously mentioned, additional permutation possibilities are hereby achieved in the set of keys in accordance with the invention. In addition, a so-called hierarchical locking system can be realized by means of the set of keys in accordance with the invention and correspondingly formed lock cylinders.

The invention furthermore relates to a key blank for manufacturing a key in accordance with the invention, wherein an elevated portion or a depression is completely arranged in a groove or recess of the key blank starting from the key tip and extending in the longitudinal direction of the key blade.

In addition, the invention relates to a set of key blanks having a plurality of key blanks in accordance with the invention, wherein the elevated portion has different heights with different key blanks and/or is received at different positions in the groove or recess, or wherein the depression has different depths and/or shapes with different key blanks, and/or wherein the depression is introduced at different positions in the groove or recess with different key blanks. A hierarchical locking system can again be realized by means of correspondingly machined key blanks and correspondingly made lock cylinders.

Figure 1A:
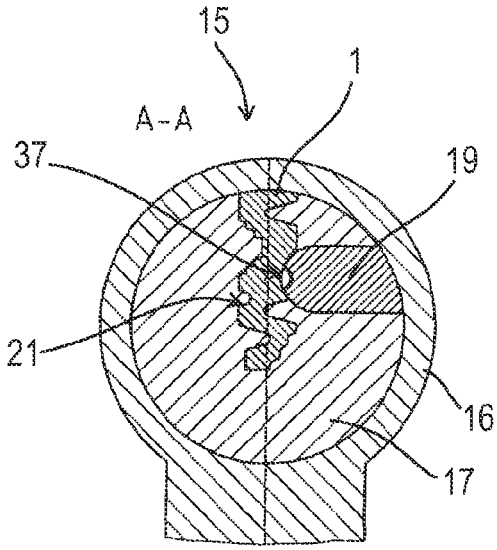
Figure 1B:
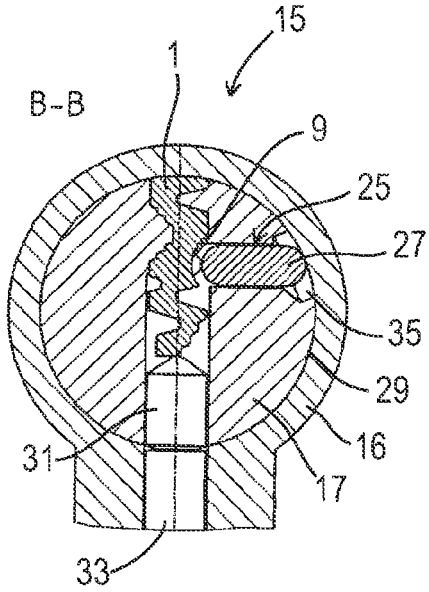
Figure 2:
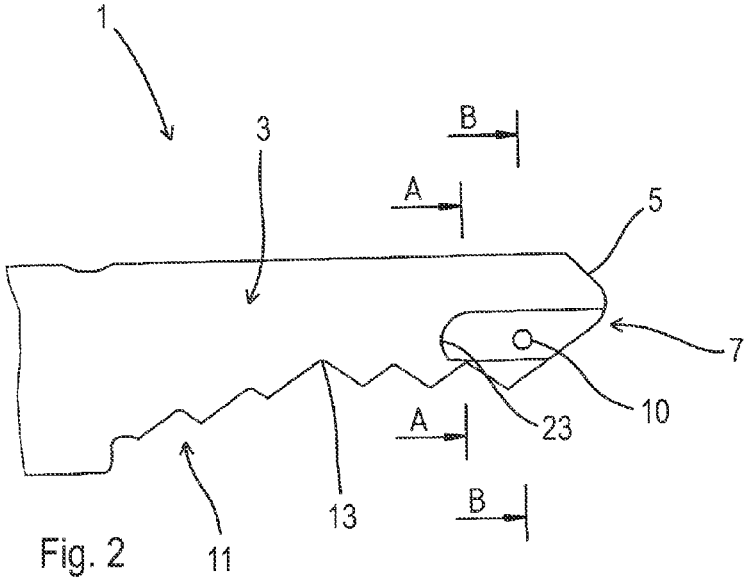
Figure 2A:
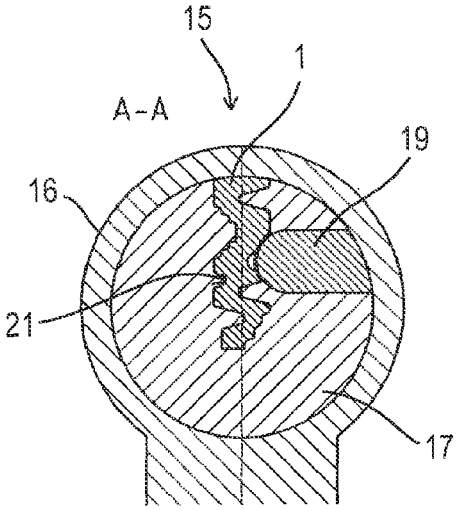
Figure 2B:
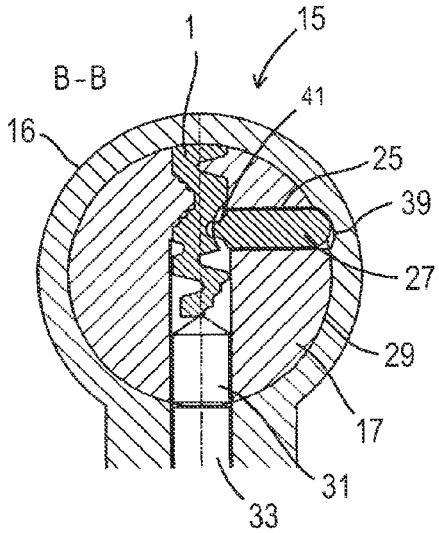
Figure 3:
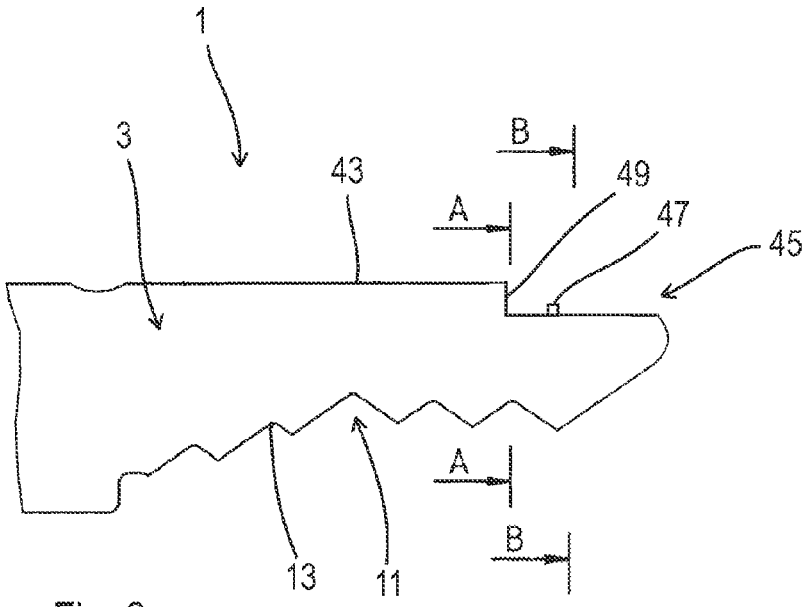
Figure 4:
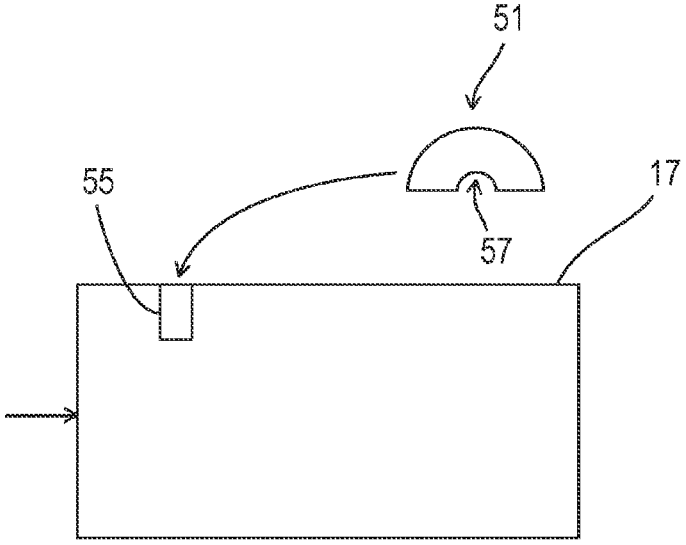
Figure 5:
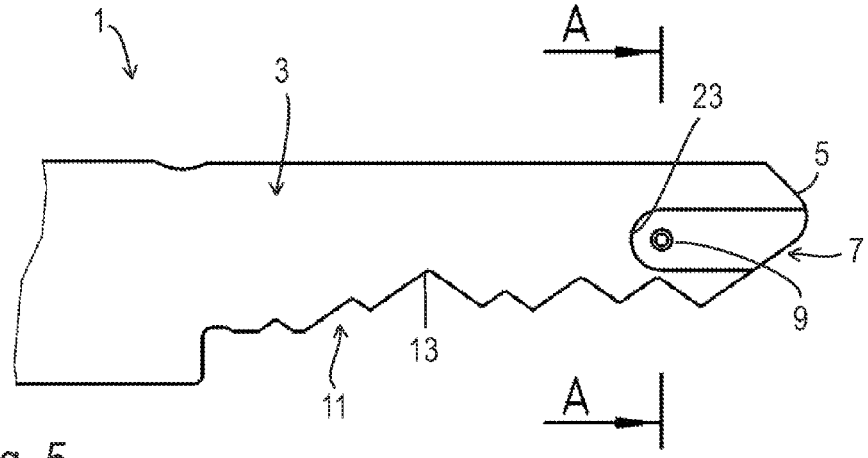
Figure 5A:
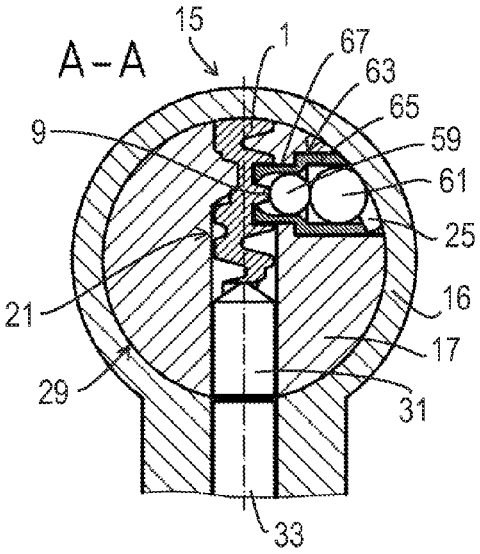
Figure 5B:
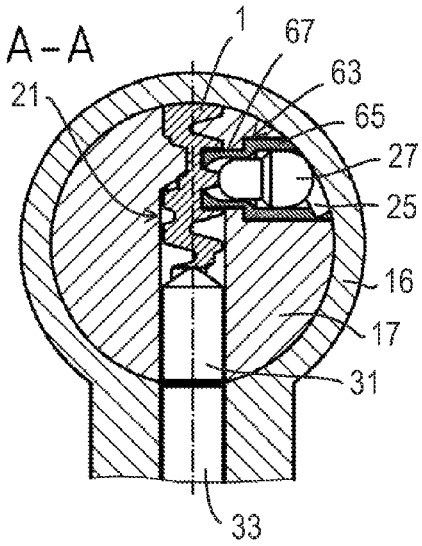
Figure 5C:
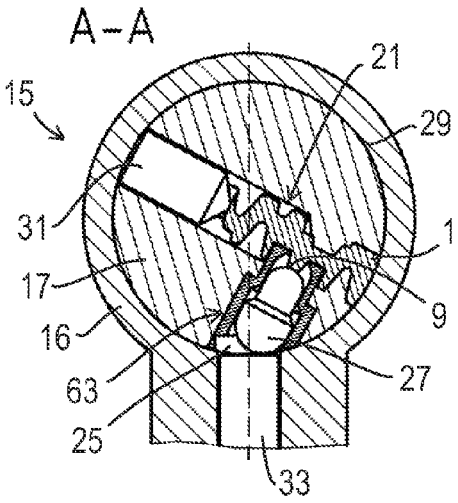
Figure 5D:
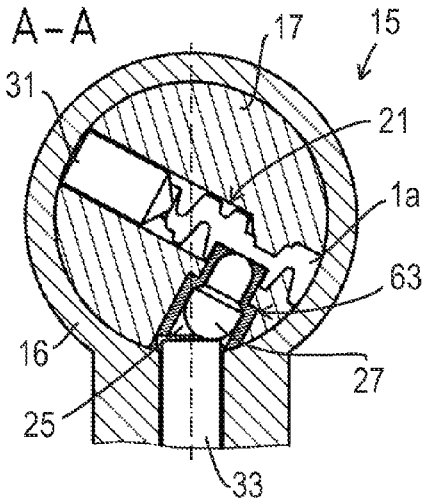
Figure 6:
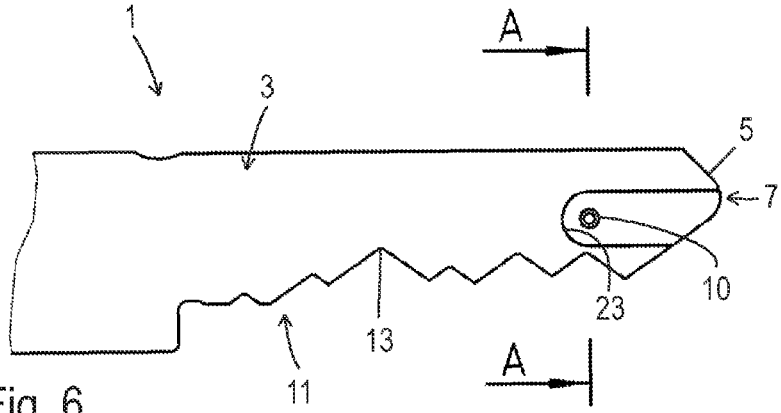
Figure 6A:
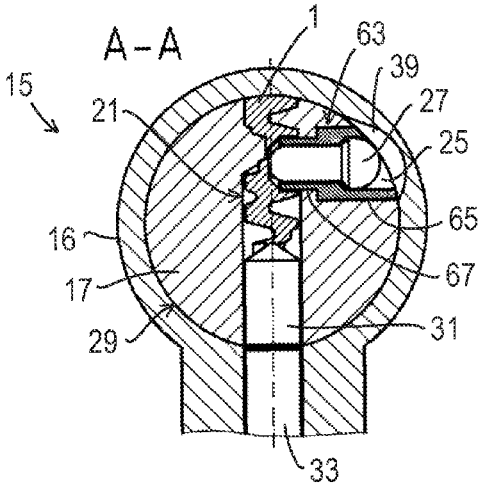
Figure 6B:
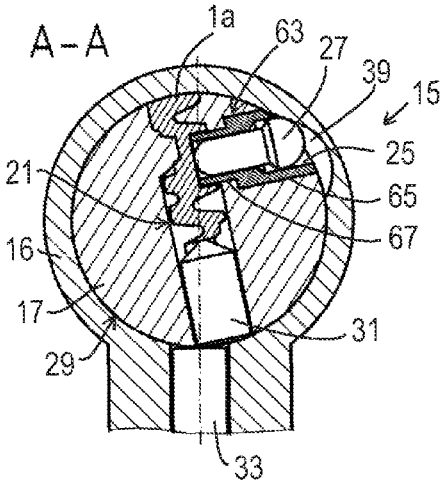
Figure 7:
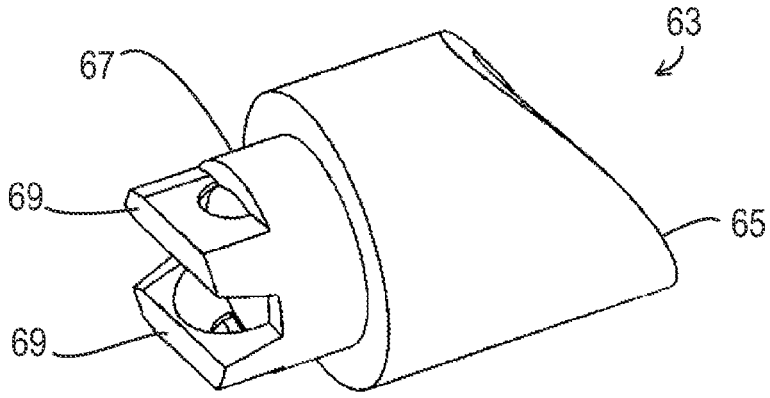
Figure 8:
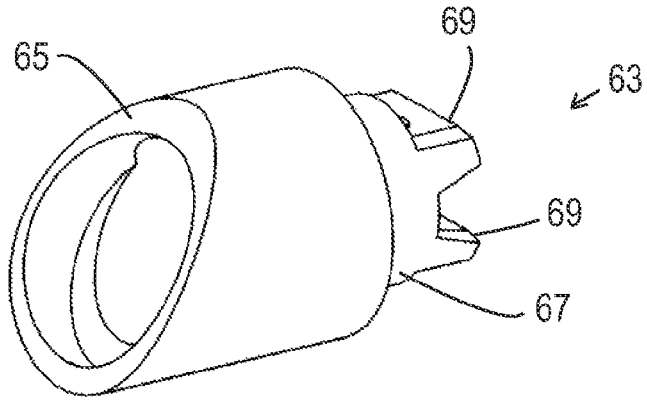
Figure 9:
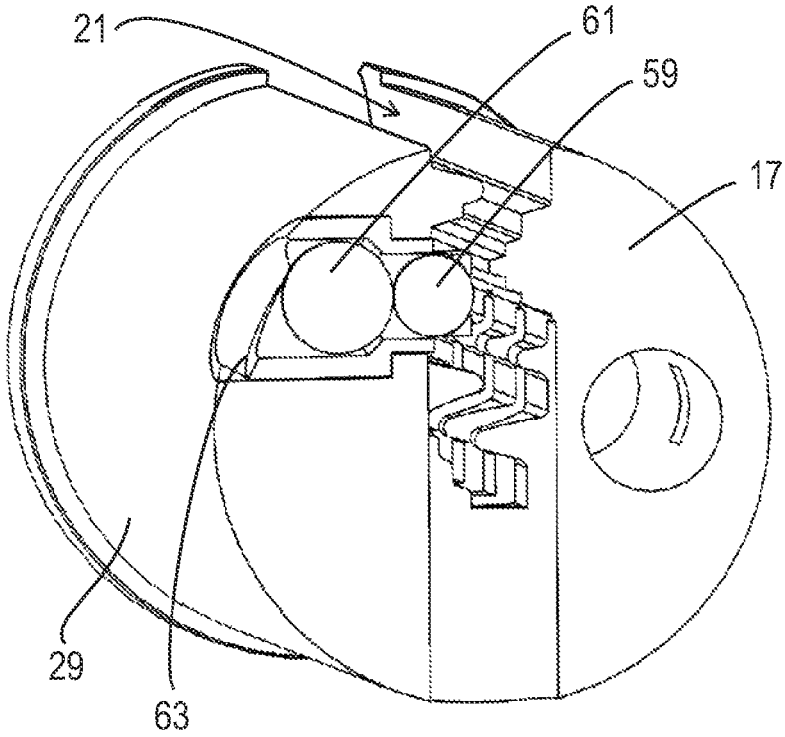
Figure 10:
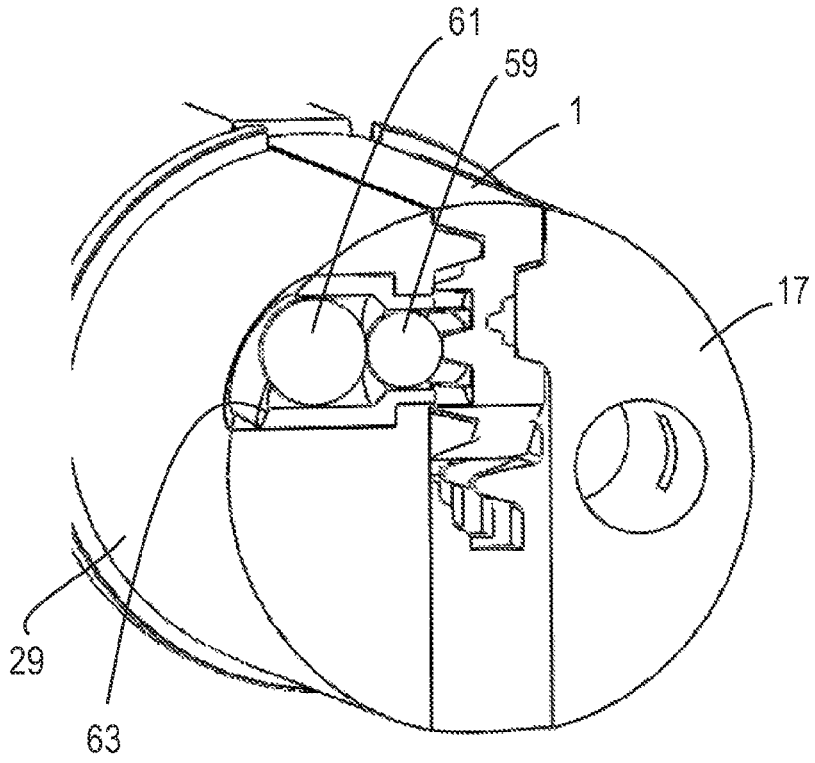

The invention will be described in the following with reference to different embodiments and to the drawings. There are shown, schematically in each case, FIG. 1 a part side view of a key of a locking system in accordance with the invention;

FIG. 1A a cross-sectional view of a lock cylinder of the locking system in accordance with the invention along a plane A-A in which the plane A-A of the key set forth in FIG. 1 lies with a key introduced to the maximum into the lock cylinder;

FIG. 1B a further cross-sectional view of the lock cylinder along a plane B-B in which the plane B-B of the key set forth in FIG. 1 lies with a key introduced to the maximum in the lock cylinder;

FIG. 2 a part side view of a key of another locking system in accordance with the invention;

FIG. 2A a cross-sectional view of a lock cylinder of the locking system along a plane A-A in which the plane A-A of the key set forth in FIG. 2 lies with a key introduced to the maximum into the lock cylinder;

FIG. 2B a further cross-sectional view of the lock cylinder along a plane B-B in which the plane B-B of the key set forth in FIG. 2 lies with a key introduced to the maximum into the lock cylinder;

FIG. 3 a part side view of a key of a further locking system in accordance with the invention; and FIG. 4 a side view of a locking cylinder core and of an abutment element at the lock cylinder side made in the form of an insert piece;

FIG. 5 a part side view of a key of a further variant of a locking system in accordance with the invention;

FIG. 5A a cross-sectional view of a lock cylinder of the locking system along a plane A-A in which the plane A-A of the key set forth in FIG. 5 lies with a key introduced to the maximum into the lock cylinder;

FIG. 5B a cross-sectional view of another variant of a lock cylinder of the locking system along the plane A-A in which the plane A-A of the key set forth in FIG. 5 lies with a key introduced to the maximum into the lock cylinder;

FIG. 5C a further cross-sectional view of the lock cylinder of FIG. 5B along the plane A-A, with the cylinder core having been rotated with respect to the lock cylinder housing a "matching" key;

FIG. 5D a further cross-sectional view of the lock cylinder of FIG. 5B along the plan A-A, with—unlike the situation shown in FIG. 5C—the cylinder core having been rotated with respect to the lock cylinder housing while using a "non-matching" key;

FIG. 6 a part side view of a key of a further variant of a locking system in accordance with the invention;

FIG. 6A a cross-sectional view of a lock cylinder of the locking system along a plane A-A in which the plane A-A of the key set forth in FIG. 6 lies with a key introduced to the maximum into the lock cylinder;

FIG. 6B a cross-sectional view of the lock cylinder of FIG. 6A along the plane A-A, with the cylinder core having been rotated using a "non-matching" key up to the blocking by the additional blocking element;

FIG. 7 a perspective view of a sleeve-like guide element;

FIG. 8 a further perspective view of the guide element of FIG. 7;

FIG. 9 a perspective view of a cylinder core of the lock cylinder of FIG. 5A; and FIG. 10 a perspective view of the cylinder core of FIG. 9 in whose keyway a "matching" key is introduced.

The key 1 shown in FIG. 1 includes a key blade 3 to whose broad side a groove 7 is arranged which starts from the key tip 5 and which extends in the longitudinal direction of the key blade 3. A counter-element in the form of a part-spherical elevated portion 9 is formed in the groove 7. In addition, the key bit 11 which is known from conventional keys and which has a plurality of notches 13 is formed at a longitudinal side of the key blade 3.

The lock cylinder 15 shown in FIGS. 1A and 1B has a lock cylinder housing 16 and a lock cylinder core 17. An abutment element 19 at the lock cylinder side made in pin form is arranged in the cross-sectional plane A-A of the cylinder core 17 shown in FIG. 1A and projects into a keyway 21 present in the cylinder core 17 for introducing the key 1. The abutment element 19 at the lock cylinder side defines the maximum insertion depth of the key 1 into the keyway 21 in combination with an abutment element 23 at the key side which is formed by the end region of the groove 7 remote from the key tip.

As can be seen from FIG. 1B, a guide passage 25 in which an additional blocking element 27 is movably arranged is formed in the cylinder core 17 in the plane B-B which also extends through the elevated portion 9 with a key 1 completely inserted into the keyway 21. In the embodiment shown in FIG. 1B, the guide passage extends transversely to the keyway 21 and thus also transversely to the direction of insertion of the key 1 so that the additional blocking element 27 can also be displaced in the guide passage 25 transversely to the direction of insertion. The guide passage 25 can, however, also extend obliquely to the keyway 21 so that the additional blocking element 27 can be displaced obliquely to the direction of insertion of the key.

As can be recognized from FIG. 1B, the elevated portion 9 cooperates with the additional blocking element 27 with a key 1 completely inserted into the keyway 21. In this respect, the additional blocking element 27 is urged outwardly in the guide passage 25 due to the effect of the elevated portion 9, that is transversely to the direction of insertion of the key 1. The additional blocking element 27 in particular moves from a starting position in which the additional blocking element 27 is inwardly spaced apart from the peripheral surface 29 of the cylinder core 17 into an aligned position with respect to the peripheral surface 29 of the cylinder core. in this respect, the peripheral surface 29 of the cylinder core 17 is also called the jacket surface and substantially contacts the inner peripheral surface of the housing 16 in a flush manner.

As mentioned further above, the key blade 3 has the notches 13. They cooperate with different tumblers with a key 1 completely inserted into the keyway 21 and displace them in a known manner such that the ends of the tumblers remote from the key blade 3 do not block a rotary movement of a cylinder core 17 present in the lock cylinder 15.

As can be seen from FIG. 1B, the guide passage 25 is located in the same cross-sectional plane B-B as one of the previously mentioned tumblers which has a cylinder core pin 31 and a housing pin 33 in a known manner. Furthermore, a guide passage section 35 adjacent to the peripheral surface 29 of the cylinder core is made so large that the housing pin 33 could penetrate into it. However, the additional blocking element 27 brought into the aligned position with respect to the peripheral surface 29 of the cylinder core due to the effect of the elevated portion 9 prevents the housing pin 33 from being able to penetrate into the section 35 on a rotary movement of the guide passage section 35 beyond said housing pin and blocks the further rotation of the cylinder core 17 relative to the housing 16. To this extent, the cylinder core 17 can only be actuated relative to the housing 16 without blocking when the "matching" key 1, in particular provided with the suitably formed groove 7 and the matchingly made elevated portion 10, is completely introduced into the keyway 21 so that the locking system in accordance with the invention guarantees a high safety standard.

It furthermore results from FIGS. 1, 1A and 1B that the additional blocking element 27 is located behind the abutment element 19 at the lock cylinder side with respect to the insertion direction of the key 1 so that the elevated portion 9 has, so-to-say, to be led past the abutment element at the lock cylinder side on the introduction of the key 1 into the keyway 21. In this respect, the groove 7 and the end of the abutment element 19 at the lock cylinder side projecting into the keyway 21 preferably have complementary surfaces which in particular contact one another areally with a key 1 introduced into the keyway 21. As was explained in detail above, the number of possible permutations from locking system to locking system can be increased by this embodiment. Further permutation possibilities result, for example, by variation of the design of a cut-out 23 which extends in the longitudinal direction of the keyway and which is formed at the end of the abutment element 19 at the lock cylinder side adjacent to the keyway 21 and through which the elevated portion 9 is movable on the introduction of the key 1 into the keyway 21.

The locking system described with respect to FIGS. 2, 2A and 2B differs from the locking system described with respect to FIGS. 1, 1A and 1B substantially in that no elevated portion is formed in the groove 7, but rather a depression 10. Furthermore, a hollow 39 which is adjacent to the cylinder core 17 and which extends in extension of the guide passage 25 is formed in the lock cylinder housing 16. Furthermore, the additional blocking element 27 (cf. FIG. 2B) is made such that it is first outwardly displaced from the groove 7 in the guide passage 25 on the introduction of the key 1 and engages in a blocking manner into the hollow 39. In this respect, a prolongation 41 complementary to the depression 10 is arranged at the end of the additional blocking element 27 which is adjacent to the keyway 21, said prolongation penetrating into the depression 10 at the maximum insertion depth of the key, whereby the additional blocking element 27 is displaced such that it is located completely within the jacket surface of the cylinder core 17 and no longer engages into the hollow 39. With a key 1 matching the lock cylinder 15, the additional blocking element 15 thus does not effect any additional latching of the cylinder core 17 relative to the cylinder housing 16. Furthermore, the guide passage 25 in the lock cylinder 15 described with respect to FIGS. 2A and 2B does not have any widened section adjacent to the housing 16 so that the housing pin 33 cannot penetrate into the guide passage 25 and thus no blocking of a rotary movement of the cylinder core 17 can thereby be achieved.

The key 1 shown in FIG. 3 differs from the keys shown in FIGS. 1 and 2 in that it does not have a groove, but rather that a recess 45 in which an elevated portion 47 is in turn arranged and which starts from the key tip 5 is formed at the longitudinal side 43 of the key blade 3 which is located at the oppositely disposed side of the key bit 11. The elevated portion 47 cooperates (not shown) in a corresponding manner as the elevated portion 9 with the key shown in FIG. 1 with an additional blocking element arranged accordingly in a lock cylinder in order in particular to displace the additional blocking element into an aligned position with a completely introduced key so that a housing pin cannot penetrate into a correspondingly large section of the guide passage, as was previously described with respect to FIGS. 1 to 1B. Furthermore, in the key 1 shown in FIG. 3, the end region 49 of the recess 45 forms an abutment element at the key side which defines, in combination with an abutment element at the lock cylinder side, the maximum insertion depth of the key into the keyway.

As in particular stated with respect to FIGS. 1A and 2A, the abutment element 19 at the lock cylinder side can be made in the manner of a pin and can furthermore be fixedly connected to the cylinder core 17. In contrast, the abutment element shown in FIG. 4 is made in the form of an insertion piece 51. FIG. 4 shows the insertion piece 51 outside the cylinder core in a position rotated by 90° with respect to its insertion position. The insertion piece 51 is in particular suitable for use as an abutment element at the lock cylinder side for a key as is described in FIG. 3 and/or for retrofitting conventional lock cylinders. In this respect, the insertion piece 51 can be inserted into an indentation 55 introduced into the lock cylinder core 17 transversely to the direction of insertion of the key (cf. the direction of the horizontal arrow in FIG. 4) so that the insertion piece 51 extends up to and into the keyway. Furthermore, the insertion piece 51 can have a cut-out 57 so that, for example, the elevated portion 47 of the key 1 shown in FIG. 3 can be moved past the insertion piece 51 on the introduction of this key into the keyway of the lock cylinder core 17.

The key 1 shown in FIG. 5, in a similar manner to the key of FIG. 1, has a groove 7 at the broad side of its key blade 3 which starts from the key tip 5 and in which a counter-element is formed in the shape of a frustoconical elevated portion 9 (cf. FIG. 5A, for example). The key bit 11 which is known from conventional keys and which has a plurality of elevated portions 13 is located at the longitudinal side of the key blade 3.

The lock cylinder 15 shown in FIG. 5A has a lock cylinder housing 16 and a lock cylinder core 17. A guide passage 25 in which the additional blocking element made in the form of two balls 59, 61 in the variant shown can be urged outwardly due to the effect of the elevated portion 9, that is can be displaced transversely to the direction of insertion of the key 1, is formed in the plane A-A which also extends through the elevated portion 9 with a key 1 completely inserted into the keyway 21. As can be seen from FIG. 5A, the guide passage 25 is not directly formed by the cylinder core 17. A sleeve-like guide element 63 by which the guide passage 25 for guiding the two balls 59, 61 is formed is rather arranged in a corresponding cut-out of the cylinder core 17.

The guide element 63 has a first section 65 with a larger outer diameter in which the larger ball 61 is arranged. The end of the first section 65 adjacent to the peripheral surface 29 of the cylinder core has such a large opening that the housing pin 33 disposed in the plane A-A could penetrate into the opening when said opening is moved past the housing pin 33 on a rotation of the cylinder core 17. A displacement of the balls 59, 61 by the elevated portion 9 takes place in the variant shown in FIG. 5A in accordance with the statements made on FIG. 1B. The ball 61 is thereby displaced into an aligned position with respect to the peripheral surface 29 of the cylinder core so that the ball 61 prevents the penetration of the housing pin 33 into the opening of the first section 65 and thus no blocking of the rotary movement of the cylinder core 17 takes place. On actuation of the lock cylinder 15 by the "matching" key, the cylinder core 17 can accordingly be rotated with respect to the housing 16 without a blocking of the rotary movement being effected by the housing pin penetrating into the opening of the first section 65.

The guide element 63 moreover has a second section 67 in which the smaller ball 61 is arranged and which projects into the keyway 21, as can be seen from FIG. 5A. The second section 67 thereby forms an abutment for the abutment element 23 which is formed by the end region of the groove 7 remote from the key tip 5.

The guide element 63 thus has a dual function since it is made, on the one hand, for the guidance of the additional blocking element which is formed by the two balls 59, 61 in the variant shown and, on the other hand, as an abutment element at the lock cylinder side for the abutment element 23 at the key side. The abutment element at the lock cylinder side disposed in a separate plane (cf., for example, FIG. 1A with the abutment element 19 at the lock cylinder side arranged in the plane A-A and FIG. 1B with the additional blocking element arranged in the plane B-B) in the above-described variant can thus be saved by the use of the guide element 63. The additional worksteps for attaching an additional abutment element at the lock cylinder side (cf. FIG. 1A) can thereby be saved, whereby the manufacture of the lock cylinder 15 is simplified and the costs can be reduced.

The variant shown in FIG. 5B differs from the variant in accordance with FIG. 5A by the design of the additional blocking element 27. It is made in the variant shown in accordance with FIG. 5B in the form of a pin which has a head arranged in the first section of the guide element 63.

As mentioned above, the guide element 63 includes a first section 65 having a larger cross-section and a second section 67 having a smaller cross-section. In this respect, the guide element 63 is arranged in a cut-out in the cylinder core 17 made in a correspondingly stepped manner, cf. FIG. 5B. The cut-out can be formed, for example, by bores whose diameters correspond to the outer diameters of the first or second sections 65, 67 and into which the guide element 63 is inserted, in particular in the manner of a seat. On the insertion of the guide element 63 into the corresponding cut-out in the cylinder core 17, the cut-out forms an abutment for the first section 65, cf. FIG. 5B. The second section 67 thereby projects with a defined depth into the keyway 21 so that it can be ensured that the second section 67 forms an abutment for the abutment element 23 at the key side of the "matching" key 1 and does not block the introduction of the key (with a guide element projecting in too deeply) or does not form an abutment (with too small a depth). The manufacture of the lock cylinder 15 can therefore be simplified in a simple manner and it can be ensured that the guide element 63 projects into the keyway 21 with a defined depth by the design of the guide element 63 with a first section 65 having a larger diameter and a second section 67 having a smaller diameter and its arrangement in a correspondingly formed cut-out in the cylinder core 17.

As can be seen from FIG. 5C, the additional blocking element 27 is moved outwardly in the guide passage 25 by the elevated portion 9 with a "matching" key 1 completely inserted into the keyway 21 such that the additional blocking element 27 moves into an aligned position with respect to the peripheral surface 29 of the cylinder core. The additional blocking element 27 thereby prevents the housing pin 33 from being able to penetrate into the guide passage 25 and being able to block the further rotary movement on a rotary movement of the cylinder core 17.

In contrast, the additional blocking element 27 is not displaced into the aligned position with respect to the peripheral surface 29 of the cylinder core on the use of a "non-matching" wrong key 1*a* which has no elevated portion 9 so that the housing in 33 can, as is shown in FIG. 5D, penetrate into the guide passage 25 and can block the further rotary movement on a rotary movement of the cylinder core 17.

The locking system described with respect to FIGS. 6, 6A and 6B differs from the locking system described with respect to FIGS. 5, 5B to 5D substantially in that no elevated portion is formed in the groove 7, but rather a depression 10. Furthermore, a hollow 39 adjacent to the cylinder core 17 is formed in the lock cylinder housing 16 and extends in extension of the guide passage 25 with a non-rotated cylinder core 17 (FIG. 6A). The additional locking element 27 is made such that it is first outwardly displaced from the groove 7 and engages in a blocking manner in the hollow 39 on the introduction of the key 1. In this respect, the end of the additional blocking element 27 which is adjacent to the keyway 21 is made complementary to the depression 10 so that the end of the additional blocking element 27 penetrates into the depression 10 with a key 1 inserted to the maximum, whereby the additional blocking element 27 is displaced such that it no longer engages into the hollow 39 and thus does not effect any additional latching of the cylinder core 17 with respect to the housing 16. As shown in FIG. 6A, the additional blocking element 27 is located in an aligned position with respect to the peripheral surface 29 of the cylinder core with a completely inserted key 1. The additional blocking element 27 thereby acts against the housing pin 33 and prevents a canting between the guide passage 25 and the housing pin 33 when the guide passage 25 is moved beyond the housing pin 33 on a rotary movement of the cylinder core 17. The opening of the guide element 63 adjacent to the housing pin 33 is, however, in this variant preferably not made so large that the housing pin can penetrate into the guide passage 25.

In accordance with the variants in accordance with FIGS. 5A and 5B, the guide element 63 also satisfies a dual function in the variant in accordance with FIG. 6A since it is provided both for guiding the additional blocking element 23 and as an abutment element at the lock cylinder side for the abutment element 23 at the key side of the groove 7 of the key 1.

On the use of a "non-matching" key 1 a which does not have the corresponding depression 10 the additional blocking element 27 engaging into the hollow 39 effects a blocking of the rotary movement of the cylinder core 17 with respect to the cylinder housing 16, cf. FIG. 6B.

As mentioned, the guide element 63 shown in FIGS. 7 and 8 has a first section 65 and a second section 57 adjoining thereat. The first section 65 is made as tubular and has, as can in particular be seen from FIG. 8, an enlarged opening at its end into which a housing pin 33 can penetrate. The second section 67 is likewise made as tubular and has two prolongations 69 which project into the keyway 21 and thus serve as an abutment for the key 1. The two prolongations 69 are made and arranged so that an elevated portion 9 in the groove of the key 1 (cf. FIG. 5) can be moved between the two prolongations 69 and so that the abutment element 23 at the lock side can come into contact with the prolongations 69.

FIGS. 9 and 10 show the cylinder core 17 of the lock cylinder 15 of FIG. 5A in a perspective and sectioned manner, with no key being introduced into the keyway 21 in FIG. 9 and with the "matching" key 1 being introduced into the keyway in FIG. 10. As can be seen from FIGS. 9 and 10, the two balls 59, 61 are urged outwardly by the matching key 1, that is are displaced transversely to the direction of insertion of the key so that the outer, larger ball 61 comes into an aligned position with respect to the peripheral surface 29 of the cylinder core and, in accordance with the statements made above with respect to FIGS. 5 to 5D, prevents a penetration of a housing pin on a rotary movement of the cylinder core 17 relative to the cylinder housing, not shown.

In the variants of a key system in accordance with the invention described with respect to FIGS. 5 to 10, the "matching" key 1 has a groove 7 on its broad side 3 having the corresponding elevated portion 9 or depression 10 respectively. It is, however, understood that the described variants of key cylinders can also be modified so that they can cooperate with a key such as is shown in FIG. 3 and which has a recess 45 having an elevated portion 47 arranged therein at the longitudinal side of the key blade 3.

REFERENCE NUMERAL LIST

1 key
1*a* wrong key
3 key blade
5 key tip
7 groove
9 elevated portion
10 depression
11 key bit
13 notch
15 lock cylinder
16 lock cylinder housing
17 cylinder core
19 abutment element at the lock cylinder side
21 keyway
23 abutment element at the key side
25 guide passage
27 additional blocking element
29 peripheral surface of the cylinder core
31 cylinder core pin
33 housing pin
35 guide passage section
37 cut-out
39 hollow
41 prolongation
43 longitudinal side
45 recess
47 elevated portion
49 end region
51 insertion piece
55 indentation
57 cut-out
59 ball
61 ball
63 guide element
65 first section

67 second section
69 prolongation

The invention claimed is:

1. A locking system having a key and a lock cylinder which has a cylinder core which is journalled in a housing and has a keyway for the introduction of the key, wherein a plurality of tumblers actuable by the key and an additional blocking element movably arranged in a guide passage of the cylinder core and displaceable obliquely or transversely to the direction of insertion of the key projects into the keyway, wherein the additional blocking element is made to cooperate with a counter-element arranged at the key blade with the key introduced up to a maximum insertion depth, wherein the counter-element is completely arranged in a groove or recess extending in the longitudinal direction of the key blade and starting from the key tip, and wherein a guide element arranged in the cylinder core forms the guide passage for guiding the additional blocking element and projects into the keyway such that the guide element forms an abutment element at the lock cylinder side which defines the maximum insertion depth of the key into the keyway, said abutment element at the lock cylinder side being for an abutment at the key side which is formed by the end region of the groove or of the recess remote from the key tip.

2. A locking system in accordance with claim 1, characterized in that the end region of the groove or of the recess remote from the key tip forms an abutment element at the key side which defines the maximum insertion depth of the key into the keyway with an abutment element at the lock cylinder side.

3. A locking system in accordance with claim 2, characterized in that the abutment element at the lock cylinder side is rigidly connected to the cylinder core, with it extending substantially parallel to the guide passage of the additional blocking element.

4. A locking system in accordance with claim 2, characterized in that the abutment element at the lock cylinder side which is made as an insertion piece is releasably connected to the cylinder core, with it extending substantially transversely to the direction of insertion of the key into the keyway.

5. A locking system in accordance with claim 2, characterized in that the abutment element at the lock cylinder side and the additional blocking element are arranged behind one another at a preset interval in the direction of insertion of the key.

6. A locking system in accordance with claim 2, characterized in that the counter-element is located between the abutment element at the lock cylinder side and the key tip with the key inserted up to the maximum insertion depth.

7. A locking system in accordance with claim 1, characterized by at least one of the groove being formed at a broad side of the key blade and the recess being made at a longitudinal axis of the key blade.

8. A locking system in accordance with claim 1, characterized in that the groove or the recess and the end of the abutment element at the lock cylinder side have complementary surfaces which contact one another with the key introduced into the keyway.

9. A locking system in accordance with claim 1, characterized in that a cut-out which is complementary to the counter-element, which extends in the longitudinal direction of the keyway and by which the counter-element is movable on the introduction of the key is formed at the abutments element at the cylinder side.

10. A locking system in accordance with claim 9, characterized in that the additional blocking element in the guide passaged can be displaced by the counter-element from a starting position in which the additional blocking element is spaced apart from the peripheral surface of the cylinder core into an aligned position with respect to the peripheral surface of the cylinder core, with the guide passage being disposed in the same cross-sectional plane of the cylinder core as a tumbler; and in that the additional blocking element is made such that, in the aligned position, it prevents a housing pin of the tumbler from being able to penetrate into a correspondingly large section of the guide passage adjacent to the peripheral surface of the cylinder core.

11. A locking system in accordance with claim 9 characterized in that the additional blocking element can be actuated by the counter-element such that it is displaced in the guide passage into an unlatched position in which no blocking takes place from a latched position in which the additional blocking element effects a blocking of the rotary movement of the lock cylinder alone or with at least one further element.

* * * * *